US007368048B2

(12) United States Patent
Narita et al.

(10) Patent No.: US 7,368,048 B2
(45) **Date of Patent: *May 6, 2008**

(54) METHOD FOR FORMING RE ALLOY COATING FILM HAVING HIGH-RE-CONTENT THROUGH ELECTROPLATING

(75) Inventors: Toshio Narita, Hokkaido (JP); Shigenari Hayashi, Hokkaido (JP); Takayuki Yoshioka, Kanagawa (JP); Hiroshi Yakuwa, Kanagawa (JP); Michiaki Souma, Hokkaido (JP); Michihisa Fukumoto, Akita (JP)

(73) Assignees: Japan Science and Technology Agency, Saitama (JP); Ebara Corporation, Tokyo (JP); Sapporo Electroplating Industrial Co., Ltd., Hokkaido (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/501,813

(22) PCT Filed: Jan. 17, 2003

(86) PCT No.: PCT/JP03/00354

§ 371 (c)(1),
(2), (4) Date: Apr. 5, 2005

(87) PCT Pub. No.: WO03/062501

PCT Pub. Date: Jul. 31, 2003

(65) Prior Publication Data

US 2005/0189230 A1 Sep. 1, 2005

(30) Foreign Application Priority Data

Jan. 18, 2002 (JP) ..... 2002-010665
Jan. 18, 2002 (JP) ..... 2002-010811

(51) Int. Cl.
*C25D 3/56* (2006.01)

(52) U.S. Cl. ..... 205/238

(58) Field of Classification Search ..... 205/238
See application file for complete search history.

(56) References Cited

U.S. PATENT DOCUMENTS 3,285,839 A 11/1966 Camp ..... 204/47

(Continued)

FOREIGN PATENT DOCUMENTS

| | | |
|---|---|---|
| JP | 54-93453 | 7/1979 |
| JP | 60-25917 B2 | 6/1985 |
| JP | 2-174253 A | 7/1990 |
| JP | 09302496 A * | 11/1997 |

OTHER PUBLICATIONS

Varypaev et al., "Electrodeposition of a Rhenium-Chromium Alloy from a Polychromatic Electrolyte", Prikladnaya Elektrokhimiya: Teoriya, Tekhnologiya i Zashchitnye Svoistva Gal'vanicheskikh Pokrytii (no month, 1983), pp. 33-34.*

(Continued)

*Primary Examiner*—Edna Wong
(74) *Attorney, Agent, or Firm*—Westerman, Hattori, Daniels & Adrian, LLP.

(57) ABSTRACT

Disclosed is a method for forming a high-Re-content alloy film, such as a Re-based film containing Re at 98% or more by atomic composition, or an alloy film containing Re in the range of 65 to less than 98% by atomic composition and at least one of Ni, Fe and Co. The method comprises performing an electroplating process using an electroplating bath containing an aqueous solution which includes a perrhenate ion, at least one ion selected from the group consisting of Ni, Fe, Co and Cr ions, and at least one of a Li ion and a Na ion. The present invention allows a high-Re-content alloy film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

3 Claims, 3 Drawing Sheets

U.S. PATENT DOCUMENTS

| | | | | |
|---|---|---|---|---|
| 3,668,083 | A | 6/1972 | Meyer et al. | 204/43 |
| 3,704,211 | A * | 11/1972 | Phillips | 205/258 |
| 3,857,683 | A * | 12/1974 | Castonguay | 428/608 |
| 4,778,573 | A | 10/1988 | Tabe et al. | 204/44.5 |
| 6,979,392 | B2 * | 12/2005 | Narita et al. | 205/238 |

OTHER PUBLICATIONS

Berezina et al., "Electrodeposition of Nickel-Rhenium Alloy from Acetate Baths", Zashchita Metallov (no month, 1993), vol. 29, No. 1, pp. 106-110.*

Artamonova et al., "Electroplating with a Tungsten-Rhenium-Nickel Alloy", Gal'vanicheskie Khim. Pokrytiya Dragotsennymi Redk. Met., Mater. Semin. (no month, 1978), pp. 67-72.*

Wikipedia, "Alkali metal", pp. 1-3 (no date).*

Patent Abstracts of Japan, Publication No. 09-302496, dated Nov. 25, 1997. Cited in the international search report.

Hisanori Fukushima, Ammonia-sei Kuensan' en Yokukara no Re-Ni Gokin Denchaku, Kinzoku Hyomen Shori, vol. 36, No. 5, pp. 198-203, 1985. Cited in the international search report, no month.

Patent Abstracts of Japan, Publication No. 09-302495, dated Nov. 25, 1997. Cited in the specification.

* cited by examiner

METHOD FOR FORMING RE ALLOY COATING FILM HAVING HIGH-RE-CONTENT THROUGH ELECTROPLATING

TECHNICAL FIELD

The present invention relates to a method for forming a high-Re-content alloy film usable as a corrosion-resistant alloy coating for high-temperature components or the like.

BACKGROUND ART

A Ni-based superalloy substrate for use in a blade for jet engines, gas turbines or the like is strictly required to have high oxidation resistance and corrosion resistance. Such required high-temperature oxidation resistance has been obtained through a surface diffusion treatment, for example, by coating a substrate surface with an $Al_2O_3$ film. For covering the insufficient performance of this treatment, there has also been developed a technique for forming a diffusion barrier layer of Pt or the like on a substrate. Rhenium (Re) can be used as the diffusion barrier layer to provide enhanced high-temperature corrosion resistance. Re excellent in thermal shock resistance is also used as high-temperature members or components of various combustors, such as a rocket-engine combustor, or high-temperature nozzles. Heretofore, there have been known the following processes for forming a Re-based film or a Re alloy film.

(1) Sputtering Process or Physical Deposition Process

A physical deposition process allows a film thickness and/or composition to be readily controlled. On the other hand, it involves problems, such as, (i) many restrictions on the size and shape of a substrate, (ii) the need for a large-scaled apparatus and complicated operations and (iii) a relatively large number of defects or cracks in an obtained film.

(2) Thermal Spraying Process

A thermal spraying process involves problems, such as, (i) a relatively large number of defects in an obtained film, (ii) lack of compatibility to the formation of thin films (10 μm or less) and (iii) poor process yield and low economical efficiency.

(3) Re-Alloy Electroplating Process

There have been known a Ni—Cr—Re alloy film having a Re content of up to 50 weight % (this percentage becomes lower when converted into atomic composition ratio), a Ni—Co—Re alloy film (see, for example, Japanese Patent Laid-Open Publication Nos. 09-302495 and 09-302496), and a Re—Ni alloy film for electric contacts, which has a Re content of up to 85 weight % (63 atomic %) (see, for example, Japanese Patent Laid-Open Publication No. 54-93453). In all of the above plated films, the content of Re is in a low level.

DISCLOSURE OF INVENTION

In view of the above circumstances, it is therefore an object of the present invention to provide a method capable of forming a Re alloy film on a surface having a complicated shape, which cannot be achieved by a sputtering process or physical deposition process.

It is another object of the present invention to provide a method capable of forming a Re alloy film at a thin thickness, which cannot be achieved by a thermal spraying process.

It is still another object of the present invention to provide a method capable of forming a higher-Re-content alloy film through an electroplating process at a low cost in a simplified manner as compared to the physical deposition process and the thermal spraying process.

Through various researches on a Re electroplating process, the inventors found that a Re alloy film having a Re content of 98% or more by atomic composition can be formed by adding into an electroplating bath an organic acid having at least one functional group selected from the group consisting of a hydroxyl group, a carbonyl group and an amino group, and controlling the respective compositions of the organic acid and a metal ion in the electroplating bath.

Specifically, according to a first aspect of the present invention provides, there is provided a method for forming a Re alloy film through an electroplating process using an electroplating bath containing an aqueous solution. In this method, the aqueous solution includes a perrhenate ion in a concentration of 0.1 to 8.0 mol/L, at least one ion selected from the group consisting of nickel, iron, cobalt and chromium (III) ions, in a total concentration of 0.005 to 2.0 mol/L, at least one of a lithium ion and a sodium ion, in a total concentration of 0.0001 to 5.0 mol/L, and at least one organic acid selected from the group consisting of carboxylic acid, hydroxycarboxylic acid and amino acid, in a concentration of greater than 5.0 to 15.0 equivalents to the concentration of all of the metal ions. Further, the electroplating bath has a pH of 0 to 8, and a temperature of 10 to 80° C. In this manner, this method can form a high-Re-content alloy film which contains Re at 98% or more by atomic composition, and serves as a heat/corrosion resistant alloy coating.

In the method set forth in the first aspect of the present invention, the alloy film to be formed may have a composition consisting of 98% or more, by atomic composition, of Re, with the remainder being at least one selected from the group consisting of Ni, Co, Fe, Mn, Cr, Mo, W, Nb, Ta, Hf, Si, Al, Ti, Mg, Pt, Ir, Rh, Au, Ag, P, B, C, Y and Ce, and inevitable impurities. This allows desired functions to be given to the film depending on a substrate and an intended purpose.

In the method set forth in the first aspect of the present invention, if the concentration of perrhenate ion is less than 0.1 mol/L, a resulting plated film cannot contain Re at 98% or more. Further, the use of a concentration of perrhenate ion greater than 8.0 mol/L causes creation of an insoluble substance in the bath. As to the at least one ion selected from the group consisting of nickel, iron, cobalt and chromium (III) ions, the use of a total concentration of the ion less than 0.005 mol/L causes significant deterioration in plating efficiency. Further, if the total concentration of the ion is greater than 2.0 mol/L, the Re content in a resulting plated film will be less than 98% by atomic composition. As to the at least one of a lithium ion and a sodium ion, if the total concentration of the ion is less than 0.0001 mol/L, the Re content in a resulting plated film will be less than 98% by atomic composition. Further, the use of a concentration of the ion greater than 5.0 mol/L causes creation of an insoluble substance in the bath to result in deteriorated flowability of the aqueous solution.

Even in case where these conditions are satisfied, if the concentration of the at least one organic acid selected from the group consisting of carboxylic acid, hydroxycarboxylic acid and amino acid, is equal to or less than 5.0 equivalents to the concentration of all of the metal ions, the Re content in a resulting plated film will be less than 98% by atomic composition. Further, the use of a concentration of the at least one organic acid greater than 15.0 equivalents causes creation of an insoluble substance in the bath to result in deteriorated flowability of the aqueous solution.

For these reasons, in the method set forth in the first aspect of the present invention, the concentration of the perrhenate ion is defined in the range of 0.1 to 8.0 mol/L; the total concentration of at least one ion selected from the group consisting of nickel, iron, cobalt and chromium (III) ions, is defined in the range of 0.005 to 2.0 mol/L; the total concentration of the at least one of a lithium ion and a sodium ion is defined in the range of 0.0001 to 5.0 mol/L; and the concentration of the at least one organic acid selected from the group consisting of carboxylic acid, hydroxycarboxylic acid and amino acid, is defined in the range of greater than 5.0 to 15.0 equivalents to the concentration of all of the metal ions.

Then, the inventors further conducted researches on a high-Re-content alloy film electroplating process using an aqueous solution, and found that a high-Re-content alloy film containing Re in the range of 65 to less than 98% by atomic composition can be formed by eliminating the potassium ion or reduce the concentration of the potassium ion in the electroplating bath, and alternatively adding an appropriate amount of lithium ion and/or sodium ion into the electroplating bath.

Specifically, according to a second aspect of the present invention, there is provides a method for forming a Re alloy film through an electroplating process using an electroplating bath containing an aqueous solution. In this method, the aqueous solution includes a perrhenate ion in a concentration of 0.1 to 8.0 mol/L, at least one ion selected from the group consisting of nickel, iron and cobalt ions, in a total concentration of 0.005 to 2.0 mol/L, a Cr (III) ion in a concentration of 0.1 to 4.0 mol/L, and at least one of a lithium ion and a sodium ion, in a total concentration of 0.0001 to 5.0 mol/L. Further, the electroplating bath has a pH of 0 to 8, and a temperature of 10 to 80° C. In this manner, this method can form a high-Re-content alloy film which contains Re in the range of 65 to less than 98% by atomic composition, and serves as a heat/corrosion resistant alloy coating.

In the method set forth in the second aspect of the present invention, the alloy film to be formed may have a composition consisting of 65 to less than 98%, by atomic composition, of Re, with the remainder being at least one of Ni, Fe and Co. This allows desired functions to be given to the film depending on a substrate and an intended purpose.

In the method set forth in the second aspect of the present invention, if the concentration of perrhenate ion is less than 0.1 mol/L, a resulting plated film cannot contain Re at 65% or more. Further, the use of a concentration of perrhenate ion greater than 8.0 mol/L causes creation of an insoluble substance in the bath. As to the at least one ion selected from the group consisting of nickel, iron and cobalt ions, the use of a total concentration of the ion less than 0.005 mol/L causes significant deterioration in plating efficiency. Further, if the total concentration of the ion is greater than 2.0 mol/L, the Re content in a resulting plated film will be less than 65% by atomic composition.

The use of a concentration of Cr (III) ion less than 0.1 mol/L causes significant deterioration in plating current efficiency. Further, the use of a concentration of Cr (III) ion is greater than 4.0 mol/L causes creation of an insoluble substance in the bath to result in deteriorated flowability of the aqueous solution. If the concentration of Cr (III) ion falls within the range of 0.1 to 4.0 mol/L, almost no Cr will be contained in a resulting plated film. Even in case where these conditions are satisfied, if the at least one of a lithium ion and a sodium ion is not contained in the bath in a total concentration of 0.0001 or more, the Re content in a resulting plated film will be less than 65% by atomic composition.

Further, the use of a concentration of the at least one of a lithium ion and a sodium ion greater than 5.0 mol/L causes creation of an insoluble substance in the bath to result in deteriorated flowability of the aqueous solution. For these reasons, in the method set forth in the second aspect of present invention, the concentration of the perrhenate ion is defined in the range of 0.1 to 8.0 mol/L; the total concentration of at least one ion selected from the group consisting of nickel, iron and cobalt is defined in the range of 0.005 to 2.0 mol/L; the concentration of the Cr (III) ion is defined in the range of 0.1 to 4.0 mol/L; and the total concentration of the at least one of a lithium ion and a sodium ion is defined in the range of 0.0001 to 5.0 mol/L.

In the method set forth in the second aspect of the present invention, the electroplating bath may contain an organic acid. This can facilitate the control of the composition of a film to be obtained. In addition, the type and concentration of the organic acid may be specified to control the composition of the film with a higher degree of accuracy. If the concentration of the organic acid is less than 0.1 equivalents to the concentration of all of the metal ions, a sufficient effect cannot be obtained. If the concentration of the organic acid is greater than 5.0 equivalents, almost none of Ni, Fe and Co as alloy elements will be contained in a resulting film. Therefore, the concentration of the organic acid is defined in the range of 0.1 to 5.0 equivalents to the concentration of all of the metal ions.

In the methods set forth in the first and second aspects of the present invention, the electroplating bath has a pH of 0 to 8, and a plating temperature of 10 to 80° C. This provides a high covering power and a plated film having a homogeneous composition. The use of a pH less than 0 (zero) causes deterioration in covering cover, and the use of a pH greater than 8 causes deteriorated flowability due to creation of a large amount of insoluble substance. The use of a plating temperature less than 1° C. causes significant deterioration in electrolytic deposition efficiency, and the use of a plating temperature greater than 80° C. causes deterioration in covering power. Therefore, the bath pH is defined in the range of 0 to 8, and the plating temperature is defined in the range of 10 to 80° C. Preferably, the bath pH is in the range of 2 to 5, and the plating temperature is in the range of 40 to 60° C.

In the methods set forth in the first and second aspects of the present invention, the electroplating bath has a pH of 0 to 8, and a plating temperature of 10 to 80° C. This provides a high covering power and a plated film having a homogeneous composition. The use of a pH less than 0 (zero) causes deterioration in covering power, and the use of a pH greater than 8 causes deteriorated flowability due to creation of a large amount of insoluble substance. The use of a plating temperature less than 10° C. causes significant deterioration in electrolytic deposition efficiency, and the use of a plating temperature greater than 80° C. causes deterioration in covering power. Therefore, the bath pH is defined in the range of 0 to 8, and the plating temperature is defined in the range of 10 to 80° C. Preferably, the bath pH is in the range of 2 to 5, and the plating temperature is in the range of 40 to 60° C.

In the methods set forth in the first and second aspects of the present invention, the electroplating bath may contain at least one ion selected from the group consisting of potassium, rubidium, cesium, calcium, strontium and barium ions. In this case, the total concentration of the at least one of lithium ion and sodium ion in the electroplating bath may be greater than the total concentration of the at least one ion selected from the group consisting of potassium, rubidium, cesium, calcium, strontium and barium ions. This makes it possible to form a Re alloy plated film having a higher Re content.

If the total concentration of the at least one of lithium ion and sodium ion in the electroplating bath is equal to or less than the total concentration of the at least one ion selected from the group consisting of potassium, rubidium, cesium, calcium, strontium and barium ions, a desirably enhanced effect cannot be obtained. Therefore, it is preferable that the total concentration of the at least one of lithium ion and sodium ion in the electroplating bath is set at a value greater than the total concentration of the at least one ion selected from the group consisting of potassium, rubidium, cesium, calcium, strontium and barium ions.

Further, in the methods set forth in the first and second aspects of the present invention, the electroplating bath may contain a sulfate ion in a concentration of 0.0001 to 5.0 mol/L, and a chloride ion in a concentration of 0.0001 to 5.0 mol/L. This causes the lowering of a liquid-junction potential, and makes it possible to achieve enhanced covering power and stable film composition. If the concentration of the sulfate or chloride ion is less than 0.0001 mol/L, these effects cannot be sufficiently obtained. Further, if the concentration of sulfate or chloride ion is greater than 5.0 mol/L, the aqueous solution cannot have enhanced flowability due to creation of an insoluble substance. Therefore, it is preferable to set the concentration of each of the sulfate and chloride ions in the range of 0.0001 to 5.0 mol/L.

BEST MODE FOR CARRYING OUT THE INVENTION

EXAMPLE

Inventive Example 1

A copper plate was subjected to degreasing/cleaning, and used as a substrate. A solution containing perrhenate ions, nickel sulfate, chromium chloride and citric acid was used as a plating bath. The chemical equivalent ratio of the organic acid to the metal ions was varied in the range of 2 to 11 to prepare plural kinds of plating baths. The pH of each of the plating baths was adjusted in the range of 3 to 8. This pH adjustment was performed using lithium hydroxide and sulfuric acid. An electroplating process was performed under the condition of a plating temperature of 50° C. and a current density of 100 mA/cm$^2$.

Figure 1:
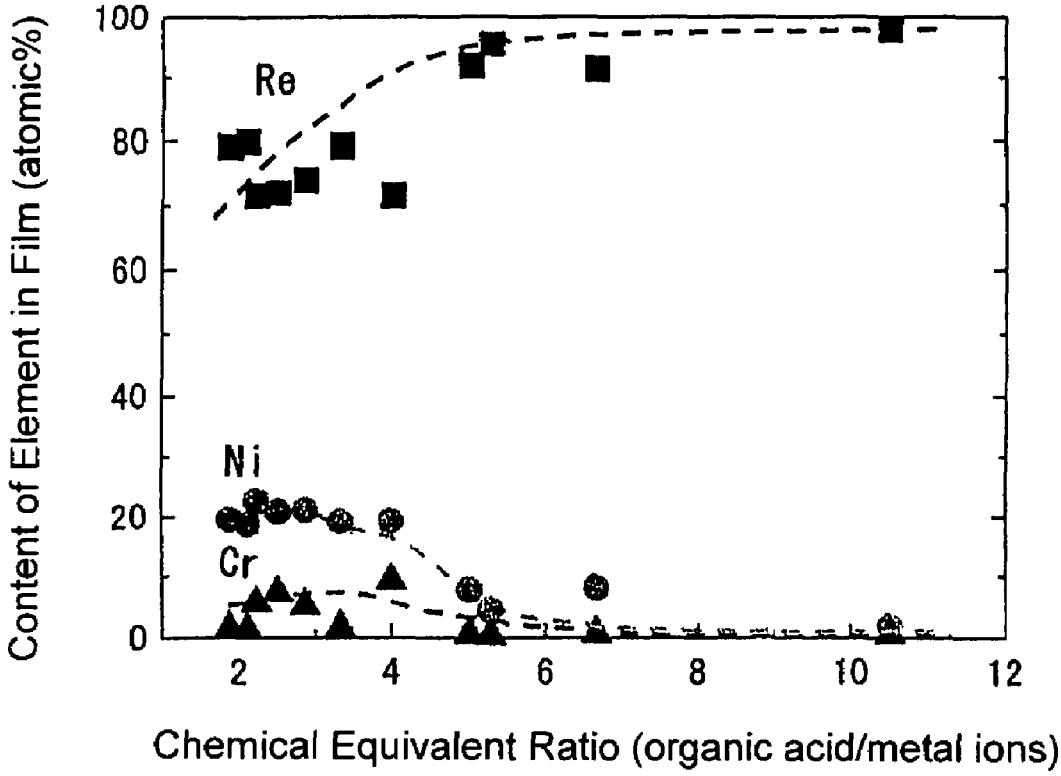
FIG. 1 is a graph showing the relationship between the chemical equivalent ratio of an organic acid to metal ions in an electroplating bath in Inventive Example 1, and the composition of a plated layer.

FIG. 1 shows the composition of a plated film, determined through a fluorescence analysis. In FIG. 1, the horizontal axis represents the chemical equivalent ratio of the organic acid to the metal ions in the plating bath, and the vertical axis represents the atomic composition of the film. As seen in FIG. 1, the composition of the plated film is dependent on the ratio of the organic acid to the metal ions in the plating bath, and the concentration of Re in the plated film is increased as the ratio of the organic acid to the metal ion is increased. More specifically, in Inventive Examples where the chemical equivalent ratio of the organic acid to the entire metal ions is 5 or more, the plated film has a Re content of 98% or more by atomic composition. In view of these data, it is verified that the composition of the metal ions and the organic acid in the plating bath can be controlled to form a plated film with a Re content of 98% or more by atomic composition, in a highly repetitive manner.

Inventive Example 2

A copper plate was subjected to degreasing/cleaning, and used as a substrate. An aqueous solution containing perrhenate ions (1.5 mol/L), nickel sulfate (0.5 mol/L), chromium chloride (0.3 mol/L) and citric acid (1.5 mol/L) was used as a plating bath. The pH of the plating bath was adjusted in the range of 3 to 8. Lithium hydroxide was used as a reagent for this pH adjustment. An electroplating process was performed under the condition of a plating temperature of 50° C., a current density of 100 mA/cm$^2$ and an electroplating period of 1 hour. An obtained plated film had a thickness of about 10 to 30 μm.

Inventive Example 3

Except that sodium hydroxide was used as a reagent for the pH adjustment in place of lithium hydroxide, an electroplating process was performed under the same conditions as those in Inventive Example 1.

Inventive Example 4

Except that lithium hydroxide and potassium hydroxide of ½ amount of that of the lithium hydroxide was used as a reagent for the pH adjustment, an electroplating process was performed under the same conditions as those in Inventive Example 1.

Comparative Example 1

Except that potassium hydroxide was used as a reagent for the pH adjustment in place of lithium hydroxide, an electroplating process was performed under the same conditions as those in Inventive Example 2.

FIGS. 2, 3, 4 and 5 show the respective compositions of plated films obtained in Inventive Example 2 (pH adjustment using lithium hydroxide), Inventive Example 3 (pH adjustment using sodium hydroxide), Comparative Example 1 (pH adjustment using potassium hydroxide) and Inventive Example 4 (pH adjustment using lithium hydroxide and potassium hydroxide of ½ amount of that of the lithium hydroxide), respectively. In each of FIGS. 2 to 5, the horizontal axis represents the pH of the plating bath, and the vertical axis represents the atomic composition of the plated film.

Figure 2:
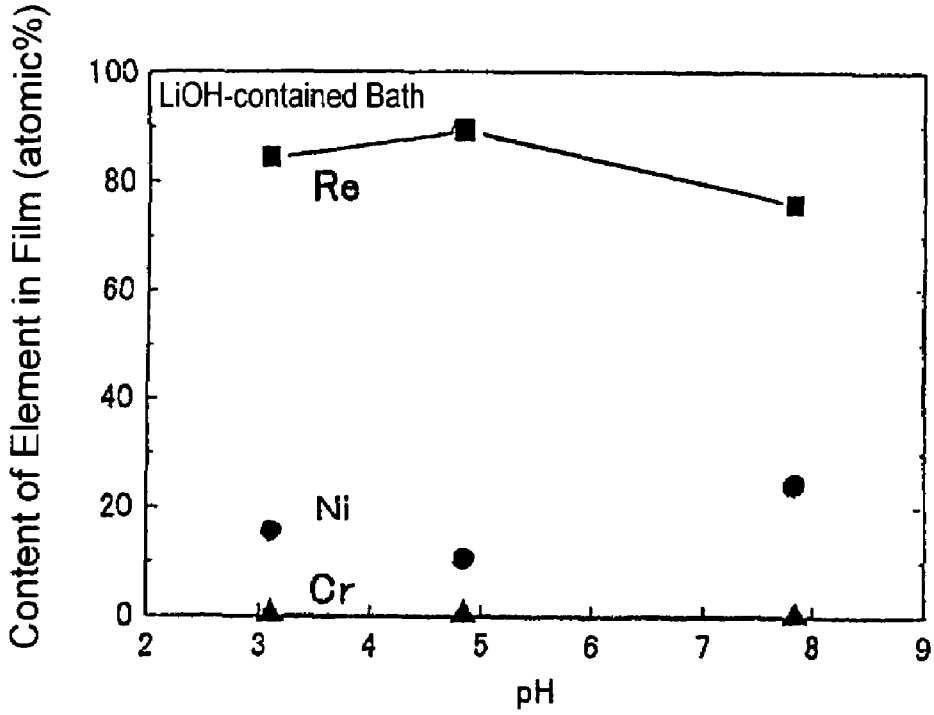
FIG. 2 is a graph showing the relationship between the pH of an electroplating bath using LiOH in Inventive Example 2, and the alloy composition of a plated film.
Figure 3:
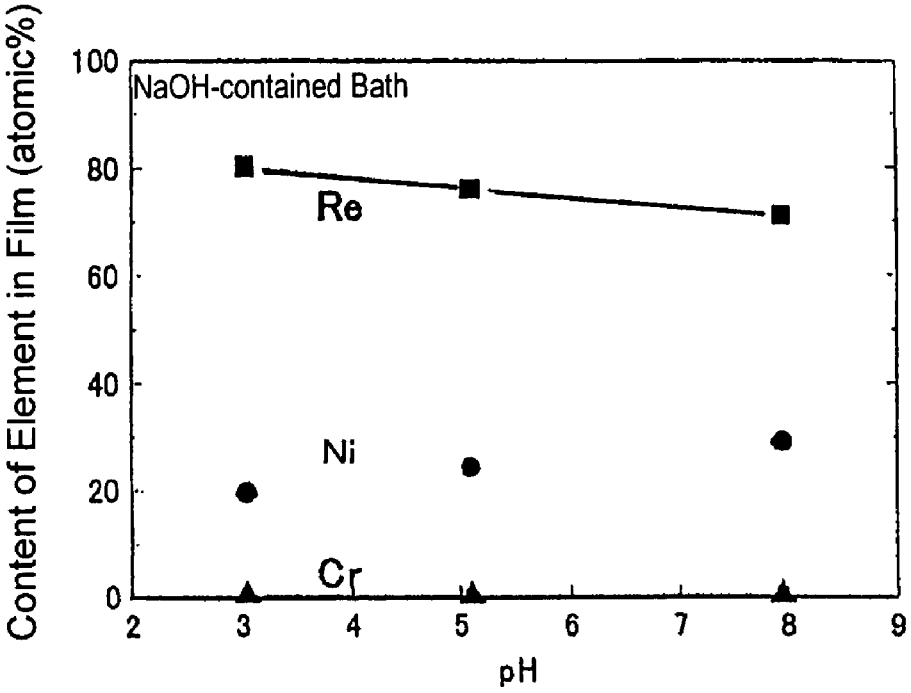
FIG. 3 is a graph showing the relationship between the pH of an electroplating bath using NaOH in Inventive Example 3, and the alloy composition of a plated film.
Figure 4:
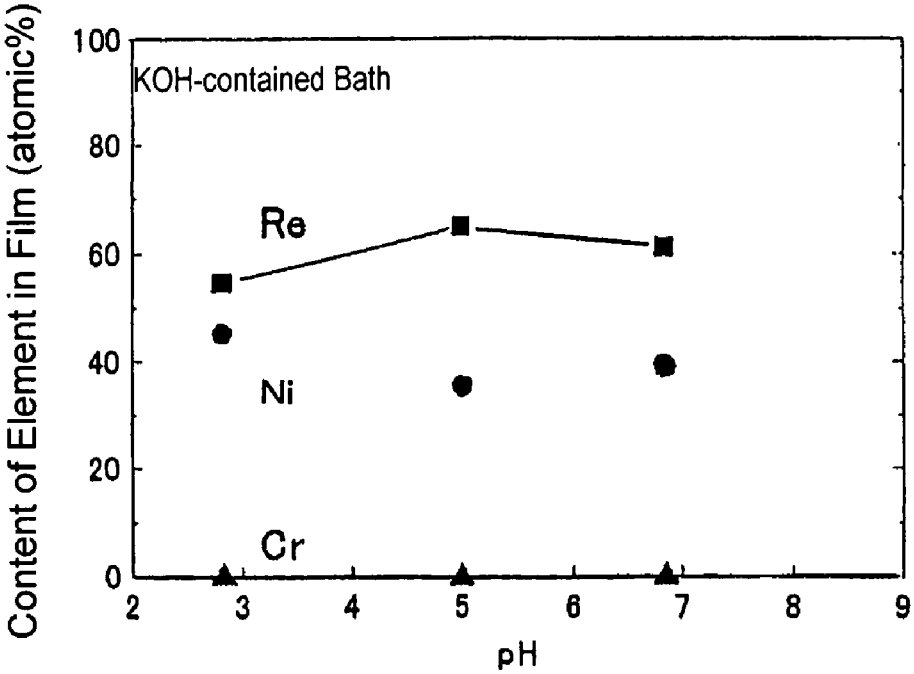
FIG. 4 is a graph showing the relationship between the pH of an electroplating bath using KOH in Comparative Example 1, and the alloy composition of a plated film.
Figure 5:
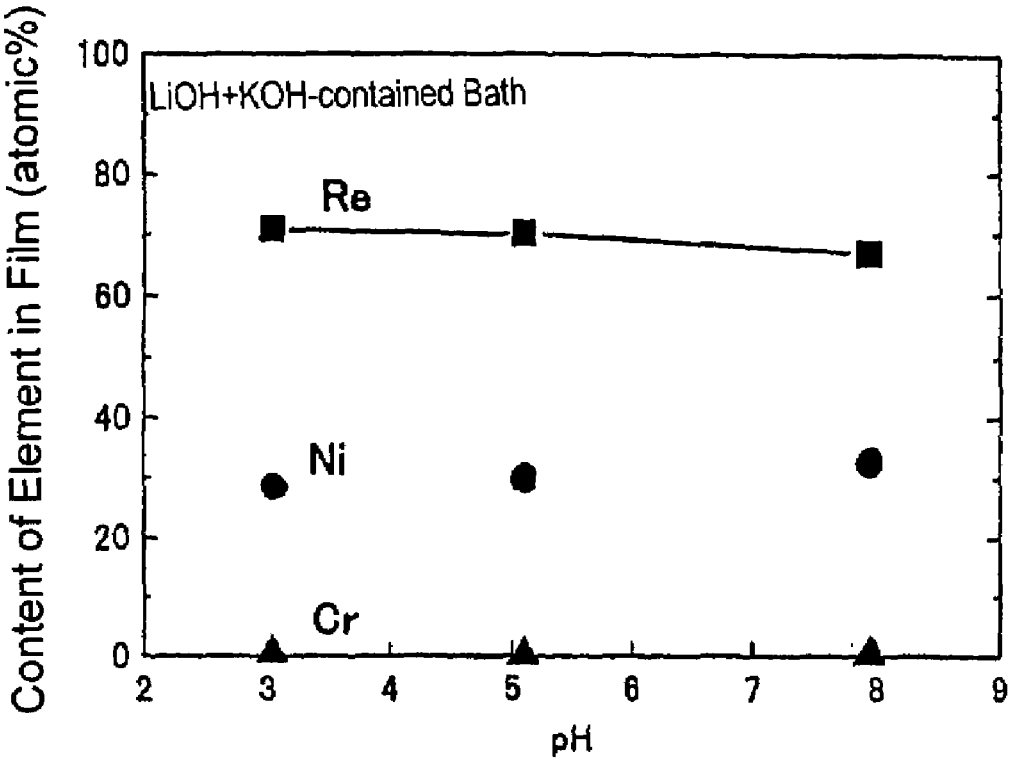
FIG. 5 is a graph showing the relationship between the pH of the electroplating bath added with LiOH and KOH of ½ amount of that of LiOH in Inventive Example 4, and the alloy composition of a plated film.

As seen in FIG. 2, in case of using lithium hydroxide, the pH can be adjusted in range of 3 to 8 to obtain an alloy film containing Re at 80% or more by atomic composition. As seen in FIG. 3, in case of using sodium hydroxide, while the Re content is slightly reduced as compared to the case of using lithium hydroxide, an obtained plated film can contain Re in the range of 70 to 80% by atomic composition. By contrast, as shown in FIG. 4, in case of using potassium hydroxide as in Comparative Example 1, the Re content is 60% or less by atomic composition, or any film containing Re at an intended high content cannot be obtained. On the other hand, in case where lithium ions are added to the plating bath at a double amount of that of potassium ions as in Inventive Example 4, an alloy film containing Re at about 70% by atomic composition can be obtained as shown in FIG. 5.

In view of the above data, it is proved that no intended high-Re-content film can be obtained if a large amount of potassium ions is mixed in a plating bath, and an intended high-Re-content alloy film can be obtained only if a lithium ion or a sodium ion, preferably a lithium ion, is contained in the plating bath.

INDUSTRIAL APPLICABILITY

The present invention allows a high-Re-content alloy film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

What is claimed is:

1. A method for forming a high-Re-content alloy film which contains Re at 98% or more by atomic composition, said method comprising performing an electroplating process using an electroplating bath which contains an aqueous solution including:

a perrhenate ion in a concentration of 0.1 to 8.0 mol/L;

at least one ion selected from the group consisting of nickel, iron, cobalt and chromium (III) ions, in a total concentration of 0.005 to 2.0 mol/L;

at least one of a Li ion and a Na ion, in a total concentration of 0.0001 to 5.0 mol/L; and at least one organic acid selected from the group consisting of carboxylic acid, hydroxycarboxylic acid and amino acid, in a concentration of greater than 5.0 to 15.0 equivalents to the concentration of all of said metal ions, wherein said electroplating bath has a pH of 0 to 8, and a temperature of 10 to 80° C.

2. The method as defined in claim 1, wherein said alloy film to be formed has a composition consisting of 98% or more, by atomic composition, of Re, with the remainder being at least one selected from the group consisting of Ni, Co, Fe, Mn, Cr, Mo, W, Nb, Ta, Hf, Si, Al, Ti, Mg, Pt, Ir, Rh, Au, Ag, P, B, C, Y and Ce, and inevitable impurities.

3. The method as defined in either one of claims 1 and 2, wherein said aqueous solution further includes at least one ion selected from the group consisting of potassium, rubidium, cesium, calcium, strontium and barium ions, wherein the total concentration of said at least one of lithium ion and sodium ion in said electroplating bath is greater than the total concentration of said at least one ion selected from the group consisting of potassium, rubidium, cesium, calcium, strontium and barium ions.

* * * * *